US008313267B2

(12) United States Patent
Johnson et al.

(10) Patent No.: US 8,313,267 B2
(45) Date of Patent: Nov. 20, 2012

(54) LANDSCAPING WALL AND MOUNTING SYSTEM AND METHODS

(75) Inventors: Jay J. Johnson, Star Prairie, WI (US); Harrison John Brown, Prior Lake, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 291 days.

(21) Appl. No.: 12/713,363

(22) Filed: Feb. 26, 2010

(65) Prior Publication Data

US 2011/0211918 A1 Sep. 1, 2011

(51) Int. Cl.
*E02D 29/02* (2006.01)

(52) U.S. Cl. ..... 405/284; 405/286

(58) Field of Classification Search ..... 405/284, 405/286; 52/28, 36.4, 305, 606
See application file for complete search history.

(56) References Cited

U.S. PATENT DOCUMENTS

| | | | | |
|---|---|---|---|---|
| 5,294,216 | A | 3/1994 | Sievert | |
| 5,788,423 | A * | 8/1998 | Perkins | 405/284 |
| 5,921,715 | A | 7/1999 | Rainey | |
| 5,943,827 | A | 8/1999 | Okerlund | |
| 6,322,291 | B1 | 11/2001 | Rainey | |
| 2001/0004822 | A1 * | 6/2001 | Martin et al. | 52/596 |
| 2008/0134615 | A1 | 6/2008 | Risi et al. | |

* cited by examiner

*Primary Examiner* — David Bagnell
*Assistant Examiner* — Benjamin Fiorello
(74) *Attorney, Agent, or Firm* — Merchant & Gould P.C.

(57) ABSTRACT

A landscaping wall includes concrete blocks dry stacked to form a wall. At least one of the blocks has a channel in the lower or upper surface of the block. An accessory mounting bar having a mounting portion and an outer end is positioned in the channel of the at least one block. At least one of an accessory or an accessory holder on the outer end of the mounting bar extends beyond the front face of the at least one block.

21 Claims, 5 Drawing Sheets

LANDSCAPING WALL AND MOUNTING SYSTEM AND METHODS

TECHNICAL FIELD

This disclosure relates to landscaping walls, including freestanding walls or retaining walls. In particular, this disclosure concerns a mounting system for adding accessories to landscaping walls and methods for using the mounting system.

BACKGROUND

Landscaping walls include both freestanding walls and retaining walls. Typically, these walls are constructed from concrete blocks that are stacked to form a wall. These blocks are typically dry stacked; that is they are not fixed together through permanent means such as mortar.

In the past, building retaining walls or freestanding walls to allow for holding or displaying miscellaneous features required the breaking of concrete blocks and/or heavy labor and planning ahead to build in the features. What is needed is a system that allows for convenient, flexible, and quick mounting of accessories on a wall.

SUMMARY

A landscaping wall is provided including a plurality of concrete blocks dry stacked to form a wall. At least one of the blocks has a channel extending at least partially between the front face of the block toward the rear face of the block. An accessory mounting bar having a mounting portion and an outer end is provided. The mounting portion is sized to permit the mounting portion to be positioned in the channel in the block. At least one of an accessory or an accessory holder on the outer end of the bar extends beyond the front face of the at least one block.

In general, the concrete blocks each have an upper surface, a lower surface, side faces joining the upper and lower surfaces, a rear face, and a front face that is generally rectangular in the front elevation view. When the blocks are dry stacked to form a wall, the upper and lower edges of the front faces of the blocks are horizontal.

In general, the upper or lower face of at least one of the blocks is formed with the channel extending at least partially from the front face of the block toward the rear face of the block.

In another aspect, a method of constructing a landscaping wall includes stacking a plurality of dry concrete blocks to form a wall. At least one of the blocks has a channel on its upper or lower face extending at least partially between the front face of the block toward the rear face of the block. The method includes positioning a mounting portion of an accessory mounting bar in the channel in the at least one block so that an outer end of the bar having an accessory or accessory holder extends beyond the front face of the at least one block.

It is noted that not all the specific features described herein need to be incorporated in an arrangement for that arrangement to have some selective advantage according to the present disclosure.

DETAILED DESCRIPTION

In general, a block is provided having a channel such that an accessory mounting bar can be conveniently and easily positioned within the channel, either during construction of the wall or after the wall is constructed. The accessory mounting bar has an outer end that includes at least one of an accessory or an accessory holder such that it extends beyond the front face of the block.

Figure 1:
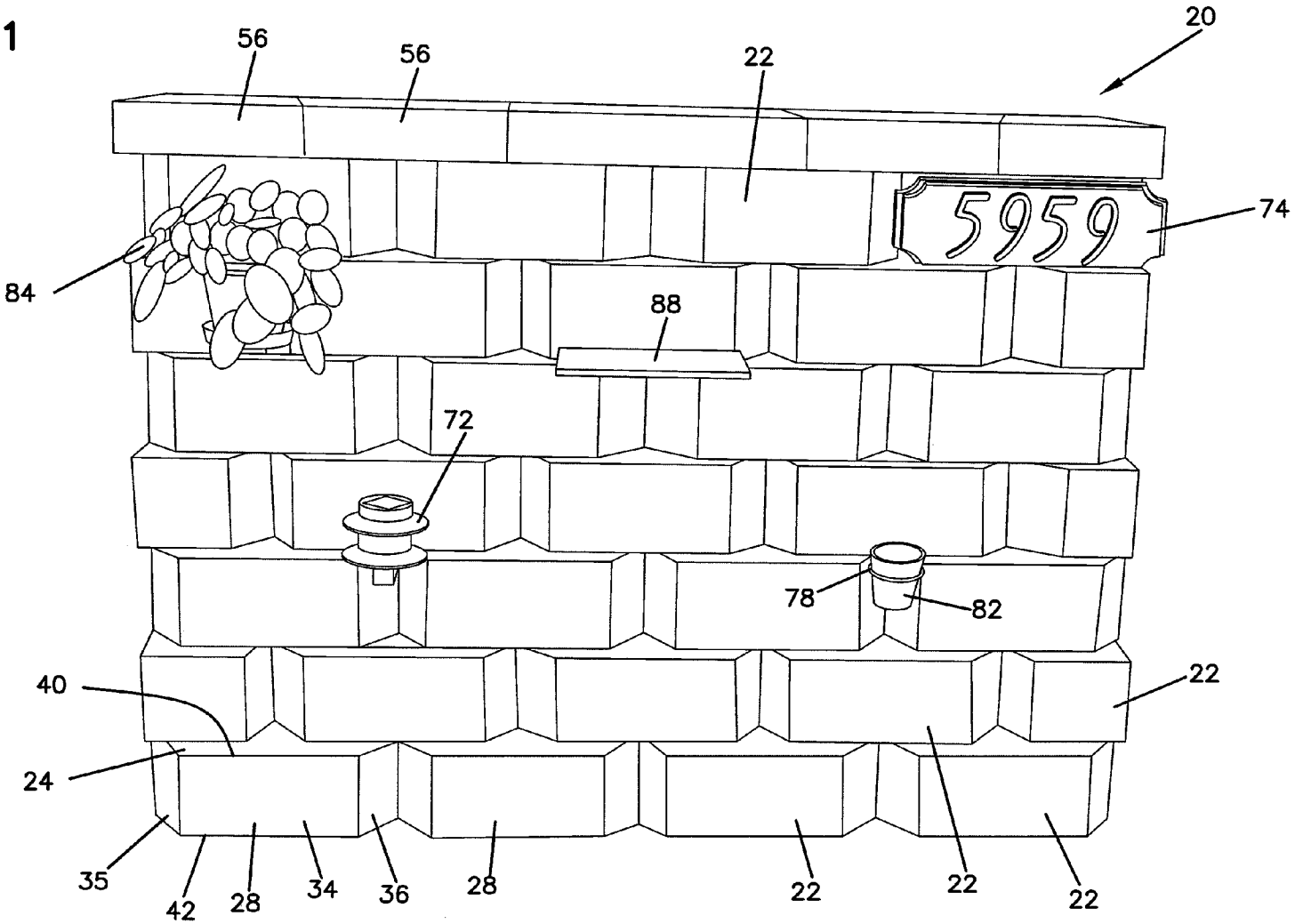
FIG. 1 is a front elevation view of a landscaping wall having accessories, constructed in accordance with principles of this disclosure.

FIG. 1 depicts a front elevation view of an embodiment of a landscaping wall generally at 20. The landscaping wall 20 may be either a retaining wall or a freestanding wall. A retaining wall is used to hold back soil or rock from a building, structure, or area. Retaining walls prevent downslope movement or erosion and provide for vertical or nearly vertical grade changes. A freestanding wall is a vertical or near-vertical structure that can be provided for ornamental landscape purposes.

In the wall 20 depicted in FIG. 20, there are a plurality of concrete blocks 22 dry stacked to form the wall 20. By the term "dry stacked," it is meant that the blocks 22 are oriented relative to each other to form the wall without the need for any mortar. The blocks 22 can be dry cast concrete blocks, or wet cast concrete blocks, or the wall 20 can include both dry cast and wet cast blocks.

Figure 3:
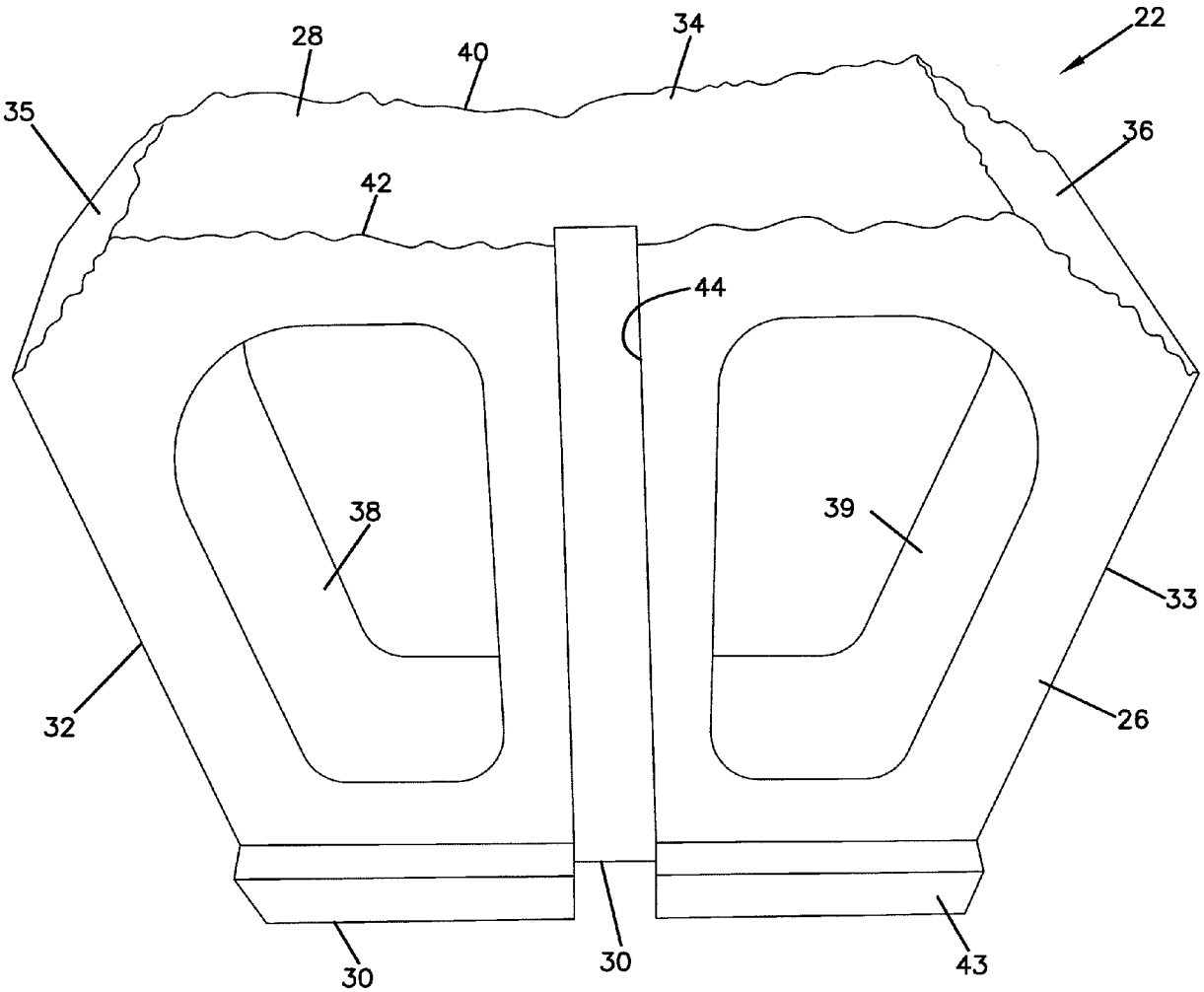
FIG. 3 is a perspective view of the bottom and front face of one of the blocks of FIGS. 1 and 2 depicting the channel in the lower surface of the block.

FIG. 3 shows a perspective view of the bottom and front face of one embodiment of a block 22 usable in the wall 20 of FIG. 1. Each of the blocks 22 has an upper surface 24 (FIG. 1), an opposite lower surface 26 and a front face 28. The front face 28, in the embodiment shown, is generally rectangular when viewed in front elevation. Opposite the front face 28 is a rear face 30. In FIG. 3, only an edge of the rear face 30 is illustrated. In many embodiments, the rear face 30 will be plain and unornamental. It is possible, however, that the rear face 30 can be textured and/or ornamented. The front face 28 can be plain, or it can be molded, textured, or ornamental, and it can be made according to methods such as described in U.S. Pat. No. 7,208,112, incorporated herein by reference.

Still in reference to FIG. 3, in this embodiment, the block 22 includes first and second side faces 32, 33 extending generally between the front face 28 and rear face 30. The front face 28 can be generally planar, or it can be faceted as shown in FIG. 3. The faceted front face 28 includes a central section 34 flanked by first and second facets 35, 36. The first facet 35 extends between the first side face 32 and the central section 34. The second facet 36 extends between the central section 34 and the second side face 33.

The first and second side faces 32, 33 are angled in a direction toward each other as they extend from the front face 28 (including the first and second facets 35, 36) in a direction toward the rear face 30. As such, in the embodiment of FIG. 3, the front face 28, in general, is wider than the rear face 30. This allows the block 22 to form curved or serpentine walls.

The block 22 depicted in FIG. 3 has a pair of cores 38, 39. The cores 38, 39 are through holes extending completely through the block 22 from the upper surface 24 to the lower surface 26. The cores 38, 39 reduce the weight of the block 22.

As illustrated in FIGS. 1 and 3, the front faces 28 of the blocks 22 include an upper edge 40 and a lower edge 42. The upper edge 40 is formed at the intersection between the front face 28 and the upper surface 24 of the block 22. The lower edge 42 is formed at the intersection of the front face 28 and the lower surface 26 of the block 22. When the blocks 22 are stacked to form the wall 20, the upper edge 40 and the lower edge 42 of the front face 28 are generally horizontal. That is, generally the upper edge 40 and lower edge 42 are parallel to the ground or surface on which the wall 20 is formed.

The block of FIG. 3 further includes a rear lip 43. The lip 43 projects from the lower surface 26 and is usable when forming a retaining wall to help form the appropriate batter. A batter is a gradual upward and backward slope, which assists the retaining wall in resisting the forces exerted on it by the retained soil. An example of retaining wall blocks with lips is described in U.S. Pat. No. 5,827,015, which is incorporated herein by reference.

Still in reference to FIG. 3, the block 22 includes a channel 44. The channel 44 can be formed in either the lower surface 26 or the upper surface 24. In the embodiment shown in FIG. 3, the channel 44 is shown as being formed in the lower surface 26. The channel 44 has a size and shape that is configured to receive an accessory mounting bar, described below. In FIG. 3, the channel 44 extends at least partially from the front face 28 toward the rear face 30 and generally perpendicular to the upper and lower edges 40, 42 of the front face 28 in front elevation view. In the embodiment shown in FIG. 3, the channel 44 extends completely from the front face 28 fully to the rear face 30.

In the embodiment shown in FIG. 3, the channel 44 has a generally rectangular cross-section. The cross-section has a height that is small enough to minimize the visibility of the channel 44. For example, the height of the channel 44 is generally not greater than one-half (½) inch, and preferably is one-fourth (¼) inch or smaller.

Figure 10:
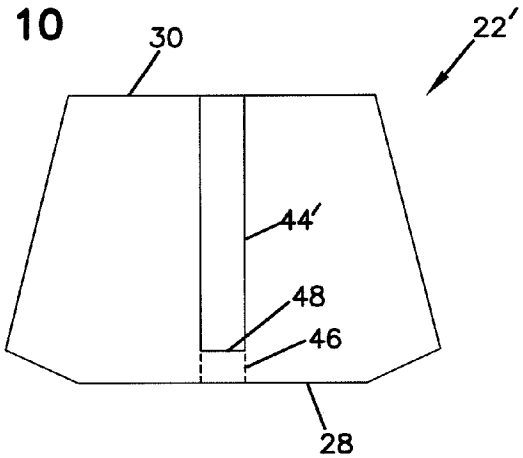
FIG. 10 is a top plan view an alternate embodiment of a concrete block with a channel, constructed in accordance with principles of this disclosure.

While in the embodiment of FIG. 3, the channel 44 extends fully between the front face 28 and rear face 30, in other embodiments, the channel 44 need not extend fully between the front face 28 and rear face 30. For example, the channel 44 may extend from the front face 28 and only partially to the rear face 30. In another example, illustrated in FIG. 10, a block 22' is depicted, in which the channel 44' extends from the rear face 30 only partially to the front face 28. In that embodiment, the block 22' may include a removable section 46 between an end 48 of the channel 44' and the front face 28. The removable section 46 may be made with weakened joints, such that it is easily removable.

Figure 2:
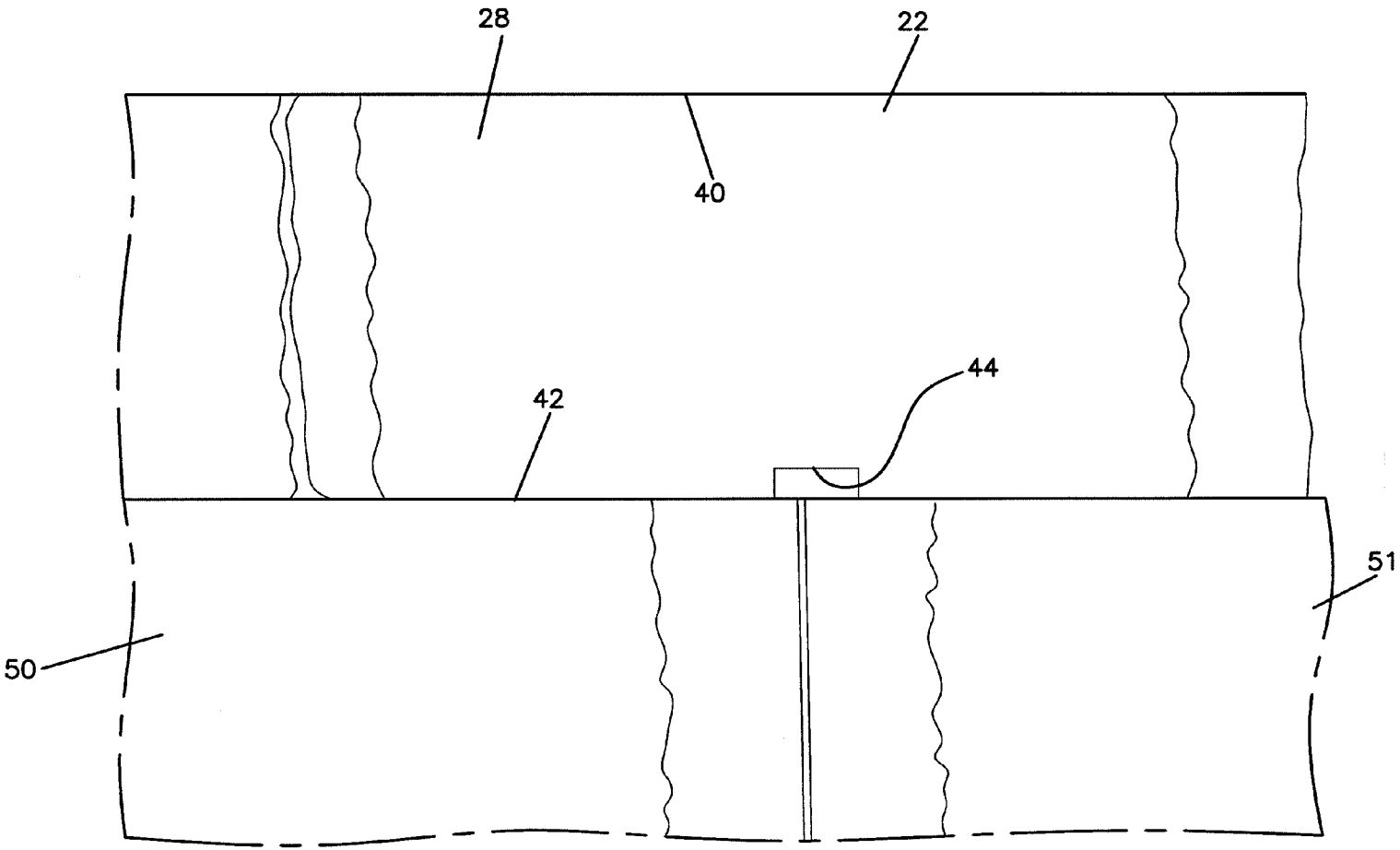
FIG. 2 is an enlarged front elevation view of a portion of the landscaping wall of FIG. 1 showing a channel in a lower surface of one of the blocks into which an accessory mounting bar may be positioned, constructed in accordance with principles of this disclosure.

FIG. 2 shows an enlarged front view of a portion of the wall 20. In FIG. 2, the block 22 having the channel 44 can be seen resting on top of two other blocks 50, 51. In this example, the blocks 50, 51 do not also have channels 44, but it should be understood that these blocks could have channels 44.

As mentioned above, the channel 44 is sized to receive an accessory mounting bar. In reference now to FIGS. 4-9 and 11, an accessory mounting bar is generally shown at 60. The accessory mounting bar 60 has a mounting portion 62 with a cross-section sized to permit the mounting portion 62 to be positioned in the channel 44 in the block 22. In the example shown, the mounting portion 62 is generally rectangular having a cross-sectional thickness that is slightly less than the cross-sectional height of the channel 44, which is generally under one-half (½) inch, and preferably under one-fourth (¼) inch.

The accessory mounting bar 60 has an outer end 64. The outer end 64 corresponds to an end of the mounting portion 62 that will be outside of or at the end of the channel 44 adjacent the front face of the block. The mounting portion 62 has an end, opposite the outer end 64, which is the mounting end 66. In the embodiment of FIGS. 4-8 and 11, the mounting end 66 will be within the channel 44 at or near the rear face 30 or near the rear end of the channel 44.

On the outer end 64 of the bar 60, there is at least one of an accessory 68 (FIGS. 5 and 7) or an accessory holder 70 (FIGS. 4, 6, 8, 9, and 11.) The accessory 68 or accessory holder 70 is secured to the outer end 64 of the bar 60 such that it extends beyond the front face 28 of the block 22, when the mounting portion 62 is positioned in the channel 44.

Figure 5:
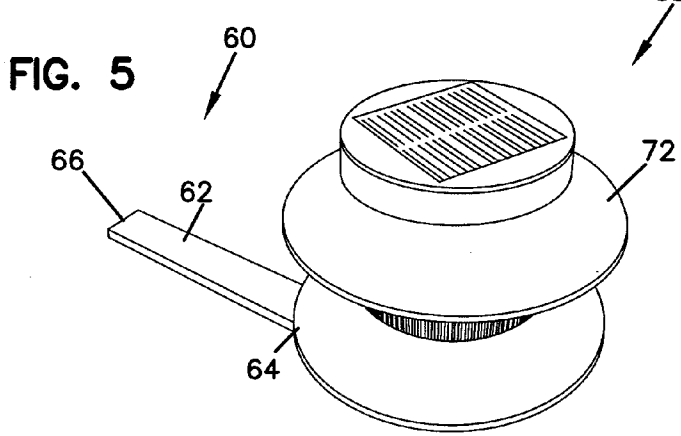
FIG. 5 is a perspective view of an accessory mounting bar holding a solar-powered light, which is shown mounted on the landscaping wall of FIG. 1.

By the term "accessory" it is meant any object or device that is not essential to the functionality of the wall 20 but adds to the aesthetics, or convenience, or effectiveness of the wall 20. The accessory 68 can include a variety of things including, for example, a mail box, a planting box, benches, hand rails, speakers (such as wireless speakers), other wireless devices such as switches, flat screen TV mounts, entertainment systems, clocks, mirrors, sculptures, pictures, and holiday decorative items (e.g., wreaths, lights, Halloween decorations). In the example of FIG. 5, a solar powered light 72 is depicted as the accessory 68.

Figure 7:
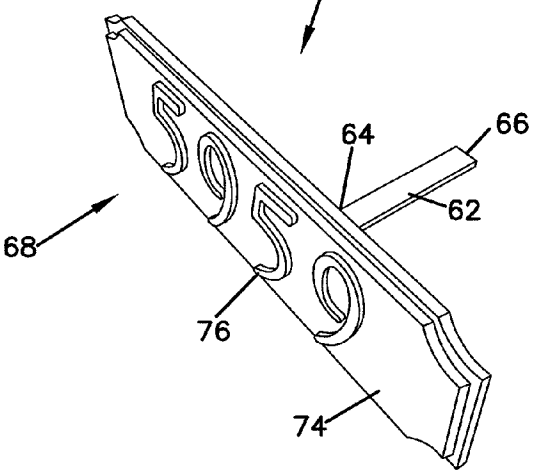
FIG. 7 is a perspective view of an accessory mounting bar having a sign accessory and is shown utilized on the landscaping wall of FIG. 1.
Figure 4:
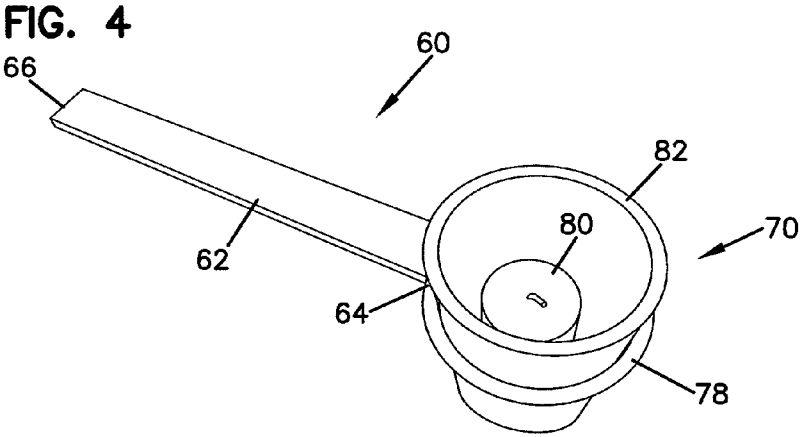
FIG. 4 is a perspective view of an accessory mounting bar holding a candle, which is shown being utilized in the landscaping wall of FIG. 1.

In the example shown in FIG. 7, the accessory 68 is shown as a display plate 74 having indicia 76. The indicia 76 are shown in the embodiment of FIG. 7 as numbers, demonstrating that the display plate 74 can be used to show an address. Of course, the indicia 76 may include any type of indicia such as letters, logos, signage, and other symbols.

Figure 6:
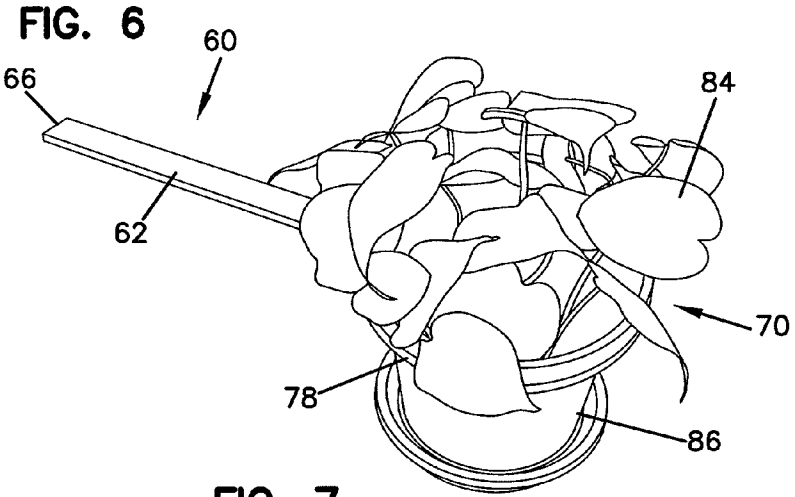
FIG. 6 is a perspective view of an accessory mounting bar holding a plant, which is shown mounted on the landscaping wall of FIG. 1.

The accessory holder 70 can be any structure that is used to hold an accessory. In the embodiment of FIGS. 4, 6, 9, and 10, the accessory holder 70 is shown as a ring 78. The ring 78 can be sized appropriately to hold the intended accessory. For example, in FIG. 4, the accessory shown is a candle 80. The candle 80 is within a cup 82, and the cup 82 fits within the ring 78. In FIG. 6, the accessory is shown as a plant 84, and the plant 84 is within a pot 86 held by the ring 78.

Figure 8:
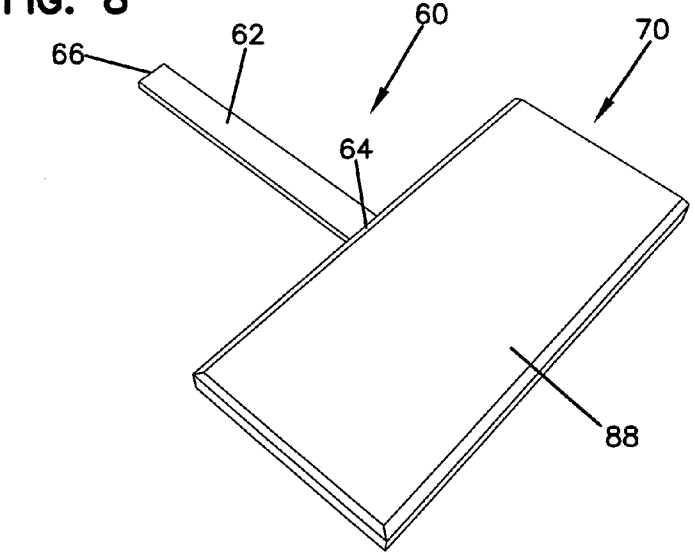
FIG. 8 is a perspective view of an accessory mounting bar having a shelf and is shown mounted on the landscaping wall of FIG. 1.

In the example of FIG. 8, the accessory holder 70 is a shelf 88. The shelf 88 can be used to hold any of a variety of accessories.

Figure 9:
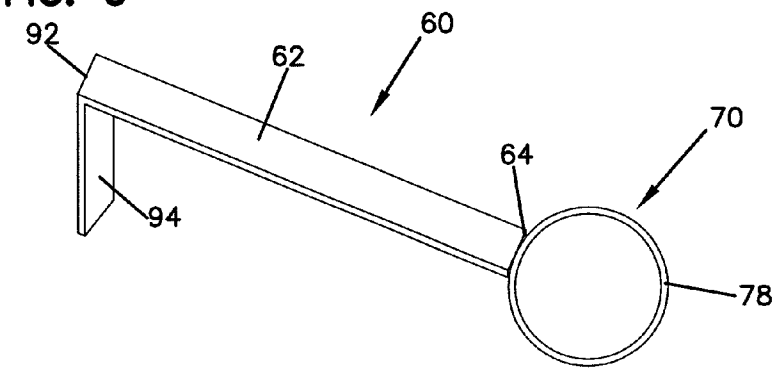
FIG. 9 is a perspective view of an accessory mounting bar having an end flange that can be utilized with the landscaping wall of FIG. 1.

In the embodiment of FIG. 9, the accessory mounting bar 60 has at least one bend 92. The bend 92 is generally greater than 70 degrees, and in the example depicted, is about 90 degrees. An end flange 94 is adjacent to the bend 92 and angled relative to the remaining portion of the mounting portion 62. In use, the end flange 94 can be used to help hold the accessory mounting bar 60 in place relative to the block 22. When the channel 44 is formed in the lower surface 26 of the block 22, then, the flange 94 can be arranged relative to the block 22 so that the end flange 94 is pointing upwardly and engages against the rear face 30 of the block 22. When the channel 44 is in the upper surface 24 of the block 22, then the accessory mounting bar 60 of FIG. 9 can be oriented such that the end flange 94 is pointed downwardly, again so that it engages against the rear face 30 of the block 22.

The accessory mounting bar 60 of FIG. 9 can either be placed in the wall 20, while the wall is being constructed and the channel 44 is fully accessible, or the end flange 94 can be formed by accessing the rear of the wall 20 and forming the bend 92 after insertion of the mounting portion 62 through the channel 44.

Figure 11:
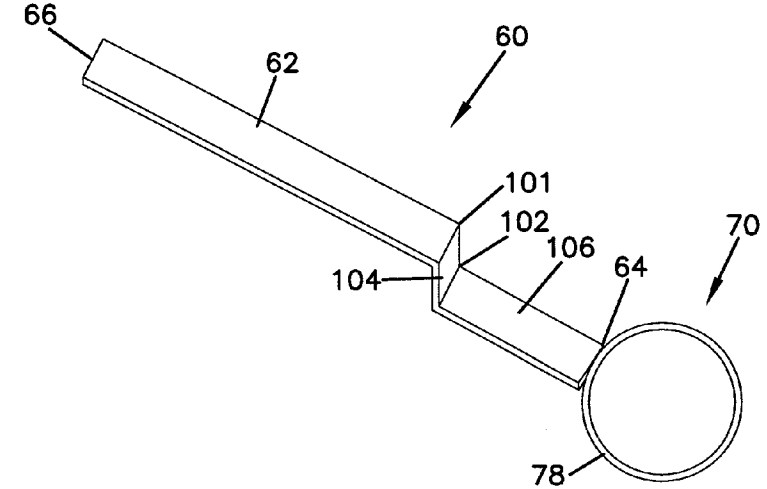
FIG. 11 is a perspective view of an accessory mounting bar having a step that can be used with the block of FIGS. 3 and 10.

In FIG. 11, the mounting portion 62 includes a pair of bends 101, 102. The bends 101, 102 are spaced closer to the outer end 64 than the mounting end 66. The bends 101, 102, in this embodiment, are greater than 70 degrees, and typically about 90 degrees to form a step 104 in the mounting portion 62. The holder 60 of FIG. 11 can be used with the block 22' of FIG. 10, in the instance when the removable section 46 is not removed. That is, the step 104 engages against the end 48 of the channel 44 (i.e. the back of the removable section 46), with the section 106 engaging against the bottom of the removable section 46 of the block 22'.

The wall 20 in FIG. 1 also shows cap blocks 56 at the top end of the wall 20. The cap blocks 56 could also include channels 44 in their lower surfaces.

The bar 60 can be made from a variety of materials including stainless steel, plastic, or fiberglass.

Utilizing the principles described above, a method of constructing a landscaping wall, such as wall 20, can be practiced. One embodiment of the method includes stacking a plurality of dry concrete blocks, such as blocks 22, to form a wall. The blocks 22 are dry stacked so that the front face 28 of each block 22 is rectangular in front elevational view and the upper and lower edges 40, 42 of each front face 28 are horizontal. At least one of the blocks 22 has a channel, such as channel 44, extending at least partially between the front face 28 and the rear face 30.

Next, an accessory mounting bar, such as mounting bar 60, is mounted on the wall block within the channel 44 so that the mounting portion 62 is positioned in the channel 44. This step is done to result in the outer end 64 of the bar 60 having accessory 68 or accessory holder 70 extending beyond the front face 28 of the block 22.

In one example, the step of positioning includes sliding the mounting portion 62 into the channel 44. In general, this step is accomplished when the channel 44 extends from the front face 28. The channel 44 can extend either completely to the rear face 30, or it may extend only partially to the rear face 30.

The method may also include a step of removing a section, such as removable section 46 (FIG. 10) of the block 22' between the channel 44' and the front face 28. After removing the section 46, the mounting portion 62 of the bar 60 is slid into the channel 44'.

The step of positioning the mounting portion 62 may also include placing the mounting portion 62 in the channel 44 and engaging end flange 94 against the rear face 30 of the block 22. This can be done while building the wall 20 while the channel 44 is fully exposed. Alternatively, this step can be accomplished by sliding the bar 60 into the channel 44 and then bending the mounting portion 62 to form bend 92 and engage the end flange 94 against the rear face 30 of the block.

The step of positioning the mounting portion 62 may also include placing the mounting portion 62 in the channel 44' (FIG. 10) and engaging stepped portion 104 (FIG. 11) against the end 48 of the channel 44' and the section 106 of the bar 60 against removable section 46. In this embodiment, the removable section 46 is not removed. Alternatively, the removable section 46 may be made so that it is not removable.

The step of positioning an accessory mounting bar 60 can include mounting any one of display plate 74, shelf 88, light 72, plant 84, candle 80, or cup 82. This step can include the outer end 64 having accessory holder 70 in the form of ring 78, and then placing the object, such as cup 82 or pot 86 in the ring 78.

The wall 20 can be either a freestanding wall or a retaining wall. It may include curves and serpentine shapes. The accessories 68 can be removed and changed. For example, as the seasons change or holidays approach, different accessories 68 may be selectively removed or added to the wall 20 by easily and conveniently changing what is held in the accessory holder 70, what is placed on the shelf 88, or what accessory 68 is displayed. In the embodiments in which the bar is slid into the mounting channel after the wall is constructed, the entire bar 60 may be removed from the wall 20 and it can either be moved to a different place on the wall or replaced by a different mounting bar and accessory; alternatively, the bar 60 can stay in place in the wall 20 and only the accessory 68 or what is being held can be replaced or moved to a different location on the wall. It should be understood that the wall 20 can include every block 22 having channel 44, or only one or a few selected blocks 22 having channel 44.

The above represents examples and principles. Many embodiments can be made in accordance with the principles of this disclosure.

What is claimed is:

1. A landscaping wall comprising:

a plurality of concrete blocks each having an upper surface, a lower surface, side faces joining the upper and lower surfaces, a rear face and a front face, the blocks being dry stacked to form a wall with the upper and lower edges of the front faces of the blocks being horizontal, a channel formed in the lower or upper surface of at least one of the blocks, the channel having a length extending at least partially from the front face of the block toward the rear face of the block, the channel having a greatest cross-sectional height transverse to the length and measured from the surface in which the channel is formed in a direction toward the other of the lower or upper surface, the height being no greater than ½ inch and less than the length of the channel;

an accessory mounting bar having a mounting portion and an outer end, the mounting portion having a cross section sized to permit the mounting portion of the bar to be positioned in the channel in the at least one block, the mounting portion having a length greater than the height of the channel; and at least one of an accessory or an accessory holder on the outer end of the bar extending beyond the front face of the at least one block.

2. The landscaping wall of claim 1 wherein the channel extends from the front face of the block and only partially to the rear face.

3. The landscaping wall of claim 1 wherein the channel extends only partially between the front face and rear face of the block; the at least one block having the channel including a removable section of the block between the channel and the front face.

4. The landscaping wall of claim 1 wherein the channel extends from the front face of the block completely to the rear face.

5. The landscaping wall of claim 1 wherein the channel extends perpendicular to the upper and lower edges of the front face in front elevation view.

6. The landscaping wall of claim 1 wherein the at least one of the accessory or accessory holder includes a display plate with written indicia.

7. The landscaping wall of claim 1 wherein the at least one of the accessory or accessory holder includes a shelf.

8. The landscaping wall of claim 1 wherein the at least one of the accessory or accessory holder includes a solar-powered light.

9. The landscaping wall of claim 1 wherein the at least one of the accessory or accessory holder holds one of a candle, a plant, or a cup.

10. The landscaping wall of claim 1 wherein the accessory mounting bar is straight and is free of bends.

11. The landscaping wall of claim 1 wherein the accessory mounting bar has at least one bend of greater than 70° therein.

12. The landscaping wall of claim 1 wherein the front faces of at least some of the blocks are wider than the rear faces and at least some of the blocks are dry cast concrete blocks.

13. The landscaping wall of claim 1 wherein the front faces of at least some of the blocks are wider than the rear faces and at least some of the blocks are wet cast concrete blocks.

14. A method of constructing a landscaping wall; the method comprising:

stacking a plurality of dry concrete blocks to form a wall, each of the blocks having an upper surface, a lower surface, side faces joining the upper and lower surfaces, a rear face and a front face, the wall having the upper and lower edges of the front faces of the blocks horizontal, the lower or upper surface of at least one of the blocks being formed with a channel having a length extending at least partially from the front face of the block toward the rear face of the block, the channel having a greatest cross-sectional height transverse to the length and measured from the surface in which the channel is formed in a direction toward the other of the lower or upper surface, the height being no greater than ½ inch and less than the length of the channel; and positioning a mounting portion of an accessory mounting bar in the channel in the at least one block so that an outer end of the bar having an accessory or an accessory holder extends beyond the front face of the at least one block, the mounting portion having a length greater than the height of the channel.

15. The method of claim 14 wherein the step of positioning includes sliding the mounting portion of the accessory mounting bar into the channel, the channel extending from the front face only partially to the rear face.

16. The method of claim 14 further including the step of removing a section of the at least one block between the channel and the front face and then sliding the mounting portion of the accessory mounting bar into the channel.

17. The method of claim 14 wherein the channel extends perpendicular to the upper and lower edges of the front face in front elevation view.

18. The method of claim 14 wherein the step of positioning includes sliding the mounting portion of the accessory mounting bar into the channel so that the outer end having one of (i) a display plate with written indicia; (ii) a shelf; or (iii) a solar powered light extends beyond the front face of the at least one block.

19. The method of claim 14 wherein the step of positioning includes sliding the mounting portion of the accessory mounting bar into the channel so that the outer end holding one of a candle, a plant, or a cup extends beyond the front face of the at least one block.

20. The method of claim 14 wherein the step of positioning includes placing the mounting portion of the accessory mounting bar in the channel and engaging an end flange of the mounting portion against the rear face of the at least one block.

21. The method of claim 14 wherein the step of positioning includes placing the mounting portion of the accessory mounting bar in the channel and engaging a stepped-portion of the mounting portion against a section of the at least one block between the channel and the front face.

* * * * *